US006281919B1

(12) United States Patent
Okada

(10) Patent No.: US 6,281,919 B1
(45) Date of Patent: Aug. 28, 2001

(54) STENCIL-MAKING DEVICE

(75) Inventor: Yoshiyuki Okada, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/503,722

(22) Filed: Feb. 14, 2000

(30) Foreign Application Priority Data

Feb. 15, 1999 (JP) ..... 11-035616

(51) Int. Cl.[7] ..... B41J 2/36
(52) U.S. Cl. ..... 347/172
(58) Field of Search ..... 347/211, 171, 347/172, 195; 400/120.09, 120.14, 120.15; 101/128.4

(56) References Cited

U.S. PATENT DOCUMENTS 5,038,154 8/1991 Yamamoto et al. .
5,526,032 * 6/1996 Nakamura ..... 347/211
5,765,477 6/1998 Yoshida .

FOREIGN PATENT DOCUMENTS 0 508 624 10/1992 (EP) .
0 958 925 11/1999 (EP) .
00102988 12/2000 (EP) .
60-161163 8/1985 (JP) .

* cited by examiner

*Primary Examiner*—N. Le
*Assistant Examiner*—K. Feggins
(74) *Attorney, Agent, or Firm*—Nixon Peabody LLP; Donald R. Studebaker

(57) ABSTRACT

In order to carry out histogram control so that colors of regions printed for overlapping regions are appropriate for a multi-color, multi-stencil thermal silkscreen stencil-making device, a hue, printing density and corresponding extracted color for ink used in multi-color, multi-stencil printing are inputted, of which a color of the densest printing density is set at a color separation circuit 36 as an extracted color for making a histogram. A histogram producing circuit 34 constituting a histogram controller 33 is then initialized, histogram data HD for the color extracted for making a histogram is acquired while reading an original, and this histogram data HD is temporarily stored in memory 37. While stencils are being made for all of the colors, the stencils are made while an energy control circuit 35 carries out histogram control based on an applied energy control signal S corresponding to histogram data HD stored in the memory 37 and binary data D3.

4 Claims, 6 Drawing Sheets

STENCIL-MAKING DEVICE

BACKGROUND OF THE INVENTION

1. Field of the Invention

The present invention relates to heat history control for a thermal head, and particularly to histogram control for a stencil-making device for making stencils used in multi-color printing using a thermal head, for every color used in printing.

2. Description of the Related Art

Conventionally, stencil making devices for stencil printing apparatus where thermo-sensitive stencils are perforated by a thermal head are well known.

In these stencil making devices, original images are read out by image scanners or given by computers connected to the stencil making devices, and stencil materials are perforated using a thermal head operated according to the signals representing the images from the scanners or computers. The perforated stencil is then wrapped around a printing drum and printing paper is inserted between the printing drum and a press roller that presses against this printing drum and rotates around its axis. Ink within the printing drum is then pressed onto printing paper through perforations in the perforated stencil and transferred to the printing paper.

The thermal head employed as an output head for making stencils has a plurality of heating elements corresponding to pixels arranged in a straight line. Perforations are then opened up in the stencil materials by heating just desired heating elements corresponding to the image data so as to form a perforated image on the stencil. When stencils are made using this kind of thermal head at an accelerated speed, thermal energy is gradually accumulated at the heat generating elements, since the perforating for the next line is started before thermal energy applied to the heat generating element is sufficiently diffused and emitted. As a result, heat is accumulated at each heating element according to its heat history. This causes unevenness in energy states and deterioration in image quality.

In order to solve this problem of deterioration of image quality caused by heat history in high-speed stencil-making devices, it is necessary to control the energy applied to the current line according to the heat history of the thermal head, i.e. to carry out heat history control. Conventionally, there is a method where heat history data (for, for example, a number of previous lines in a sub-scanning direction) for each heating element and its surrounding heating elements is stored in heating element units and the energy applied to the current line is controlled based on this heat history data so as to control the amount of heat generated by the heating elements (for example, refer to Japanese Unexamined Patent Publication No. 60(1985)-16113, and Japanese Unexamined Patent Publication No. 2(1990)-8065). There is a further method where heating data corresponding to the total amount of heat for a previous number of lines is added up and the heating amount for the thermal head is controlled block-by-block for the block units arranged in the main scanning direction or collecting up all of the blocks in the main scanning direction based on the heating data. Heating data corresponding to the total amount of heating of the head is added up by a method of providing a thermistor at a prescribed location on the thermal head and detecting the temperature of the thermal head using the sensor and adding up the heating data, or a method of adding up heating data based on perforation data for a method such as, for example, counting a number of black pixels of perforation data (binary data), calculating a black pixel ratio corresponding to a printing ratio. The heating data is then added up based on the perforation data. The carrying out of thermal history control based on this added up heating data is then referred to as "histogram control" and the heating data employed in this control is referred to as "histogram data".

This histogram control controls energy applied to a thermal head according to the heat history of the thermal head. Therefore, with stencil-making devices for multicolor printing involving a plurality of stencils, when stencils are used for each color, it is preferable for histogram control to be carried out based on histogram data obtained for each color.

However, when histogram control is carried out based on histogram data obtained for each color in this manner, there are cases where the hue of regions that are printed in an overlaid manner is inappropriate even when the colors of regions of printed matter where colors are printed independently are appropriate.

The cause of this was investigated, but no definite cause was found. On the other hand, when histogram control is carried out for stencils for other colors based on histogram data for a color for which the printing density is greatest of the colors of ink used in printing, or when histogram control is carried out for stencils for each color based on histogram data for the color of the greatest printing density (for example, black when the color of the printing inks are yellow, cyan and magenta) and of a different hue to all of the inks used in printing, improvement in the inappropriateness of hues of regions where printing overlaps can be discerned.

It is therefore the object of the present invention, based on the above knowledge, to provide a stencil-making device for use in multi-color printing, for carrying out histogram control in such a manner that regions printed in an overlapping manner do not have inappropriate hues.

SUMMARY OF THE INVENTION

A stencil-making device, for making stencils used in multi-color printing using a thermal head, comprises energy control means for subjecting energy to be applied to the thermal head to histogram control based on heating data for a number of previous lines in a sub-scanning direction of the head. The energy control means obtains the heating data for a prescribed color of a density greater than the density of ink used in printing with a stencil and subjects at least a stencil for one color to applied energy control based on the obtained heating data.

"Histogram control" refers to adding up heating data based on perforation data and then performing heat history control based on this added up heating data. Counting of the number of black pixels for the perforation data, calculating the black pixel ratio and adding up the heating data can be performed while adding up the heating data based on the perforation data. This is by no means limited to calculating the black pixel ratio, providing that the heating data for the previous number of lines in the sub-scanning direction of the thermal head is added up based on the perforation data.

The "prescribed color" can be the same hue as any of the inks used in printing or can be a different hue to any of the inks used in printing. When the hue is different, the ink having this color is imaginary.

A stencil-making device, for making stencils used in multi-color printing using a thermal head, comprises energy control means for subjecting energy to be applied to the thermal head to histogram control based on heating data for a number of previous lines in a sub-scanning direction of the head. The energy control means obtains the heating data for a color of a different color and hue to and greater density than any color of ink used in the printing and subjects stencils for all of the colors used in the printing to applied energy control based on the heating data.

An ink having "a different hue to an ink of any color used in the printing and a greater density than the color of any ink" is also imaginary.

A stencil-making device, for making stencils used in multi-color printing using a thermal head, comprising energy control means for subjecting energy to be applied to the thermal head to histogram control based on heating data for a number of previous lines in a sub-scanning direction of the head. The energy control means obtains the heating data for the densest color of the colors of inks used in the printing, and subjects the stencils for all of the colors used in the printing to applied energy control based on this heating data.

It is preferable for the energy control means of the stencil-making device to further comprise color separation means, provided separately from color separation means for color-separating inputted image data for use in making perforation data, for color-separating the inputted image data for use in calculating heating data.

In the above, "heating data for the previous number of lines in a sub-scanning direction of the head" refers to heating data for use in histogram control corresponding to the total amount of heat for a previous number of lines in a thermal head sub-scanning direction. "Total amount of heat for a previous number of lines" refers to the total amount of heating of the previous few lines of heating elements, of the multiplicity of heating elements constituting the thermal head, that are subjected to energy control, and by no means implies all of the heating elements constituting the thermal head. For example, when one line is partitioned into a plurality of blocks and histogram control is carried out for each block, the total amount of heat for the previous few lines for the heating elements forming a block is sufficient for each block. When one line is partitioned into a plurality of blocks and histogram control is carried out for each block, the total amount of heat for the previous few lines can be obtained so as to be inclusive of heating elements forming other blocks, as well as the heating elements forming the blocks subjected to control.

"Density" is the printing density when printing on printed matter using each ink (including imaginary ink) and means the density of the color printed with the ink, with the same being the case in the following.

According to the stencil-making device of the present invention, based on the above knowledge, histogram control is carried out for stencils for other colors based on heating data for a color for which the printing density is greatest of the colors of ink used in printing, or when histogram control is carried out by carrying out energy control for stencils for each color based on heating data for the color of the greatest printing density of a different hue to all of the inks used in printing. Improvements in the inappropriateness of hues of regions where printing overlaps can therefore be achieved.

Even when making a stencil for at least one color, as well as making stencils for multi-color printing, inappropriateness of hues of regions printed in an overlaid manner can be improved by carrying out applied energy control based on heating data for a prescribed color having a density greater than the density of ink used in printing using a stencil.

DETAILED DESCRIPTION OF THE INVENTION

The following is a detailed description with reference to the drawings of the preferred embodiments of the present invention.

Figure 1:
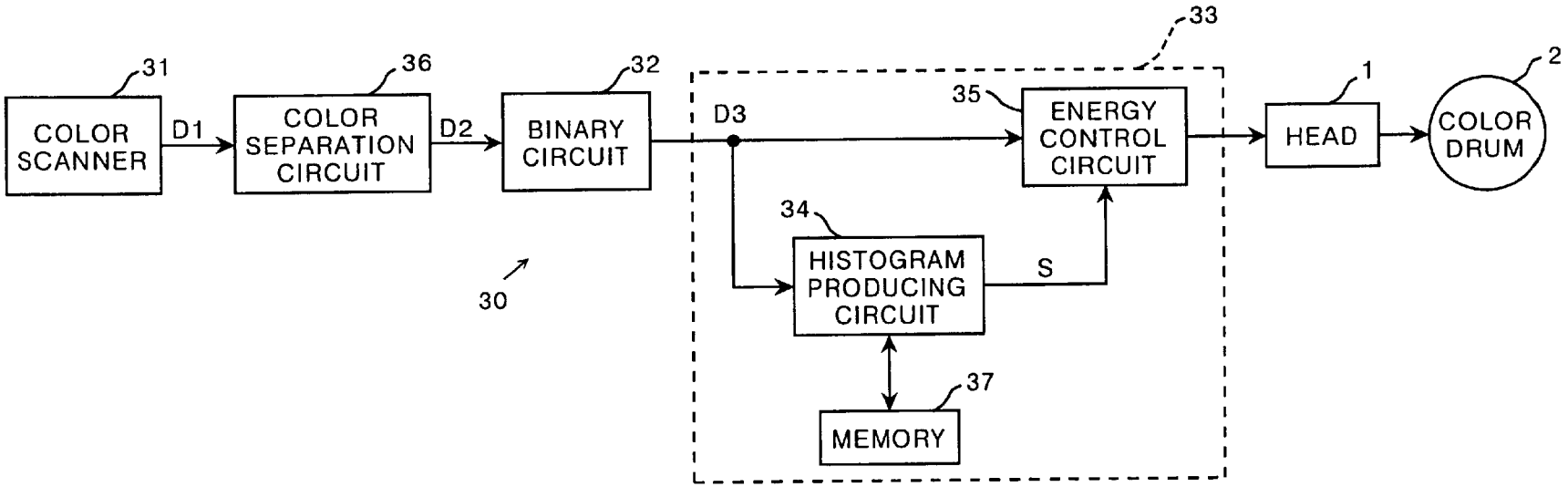
FIG. 1 is a block circuit diagram of a stencil-making device of the present invention.
Figure 2:
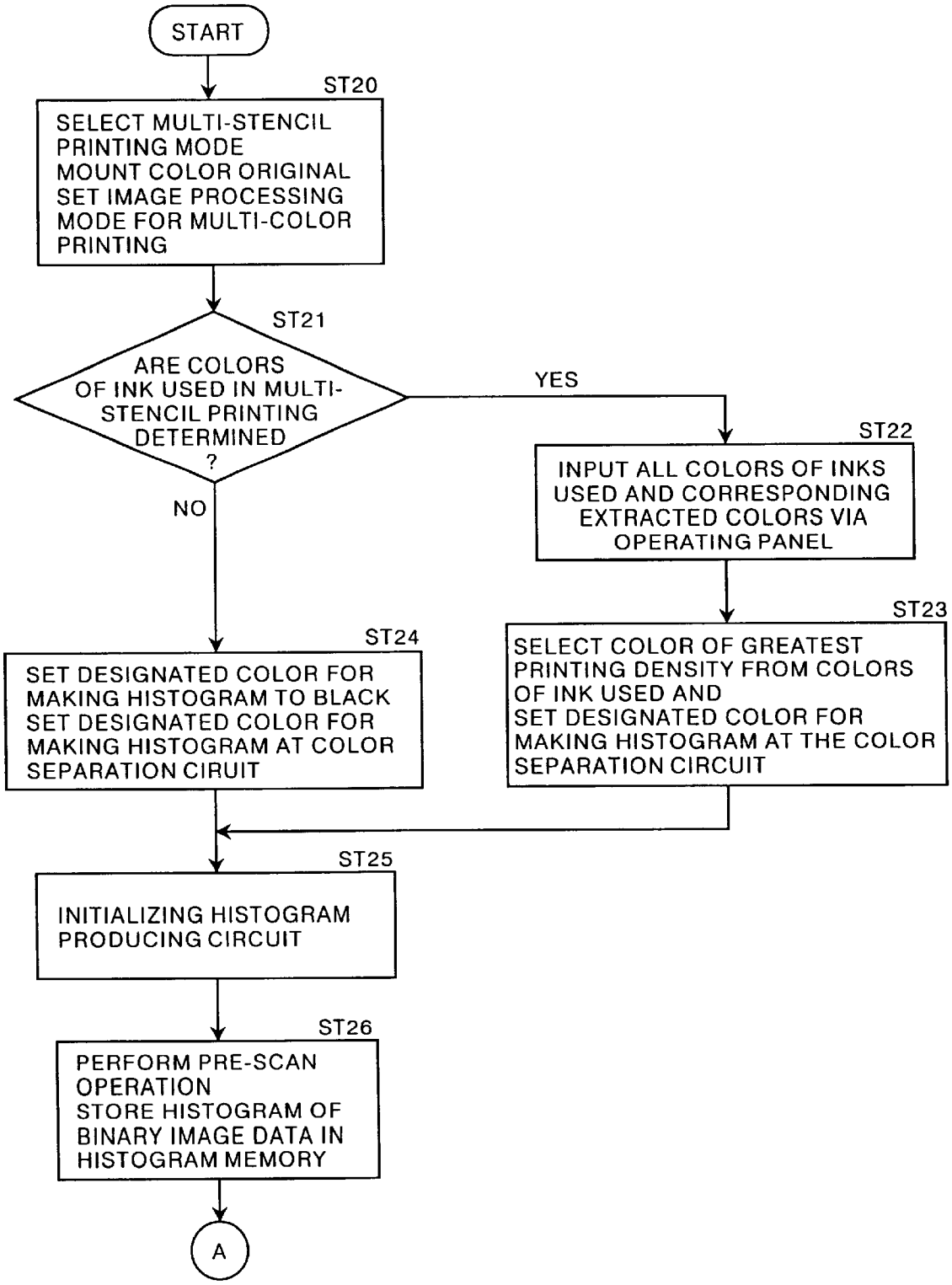
FIG. 2 is a first flowchart describing the operation of the stencil-making device (one of two)

FIG. 1 is a block circuit diagram of a stencil-making device of the present invention that carries out histogram control and FIG. 2 is a flowchart illustrating the operation of the stencil-making device.

A thermo-sensitive stencil-making device 30 for use in multi-color printing comprises a color scanner 31 for acquiring a color image signal D1 by reading a color original, a color separation circuit 36 for generating image data D2 for color separation and for obtaining a histogram based on the color image signal D1, a binarizing circuit 32 for converting image data D2 for the extracted color into binary data D3, and a histogram controller 33, constituting one embodiment of an energy control means, for performing histogram control described later based on the binary data D3.

The histogram controller 33 comprises a histogram producing circuit 34 for obtaining histogram data HD based on the binary data D3 and providing an energy control circuit 35 with an applied energy control signal S corresponding to the data HD, a memory 37 for storing the obtained histogram data HD, and the energy control circuit 35, for controlling energy applied to the thermal head 1 based on the binary data D3 and the applied energy control signal S.

Figure 3:
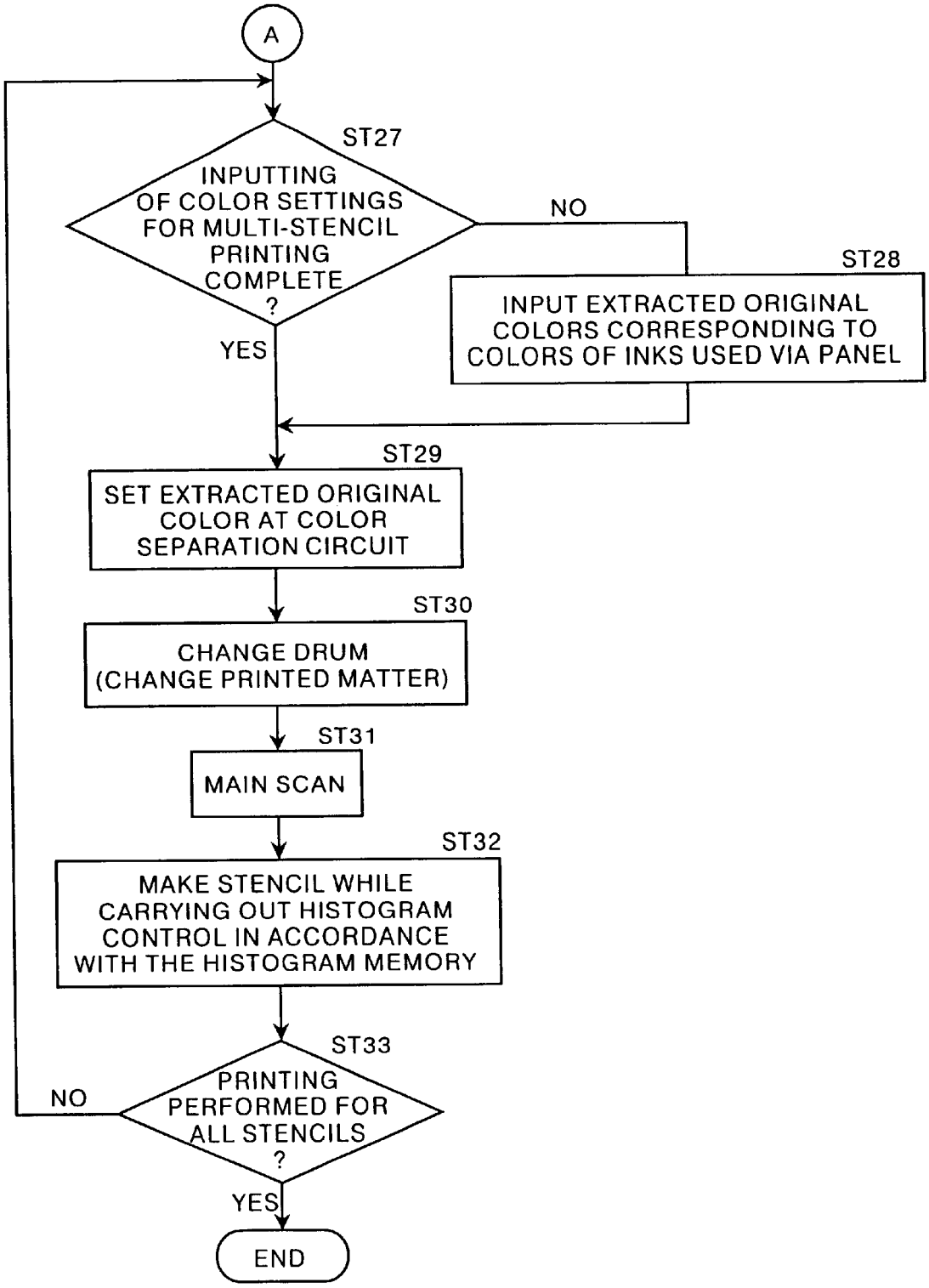
FIG. 3 is a second flowchart describing the operation of the stencil-making device (two of two)

The following is a description of the operation of the stencil-making device 30 with reference to flowcharts shown in FIG. 2 and FIG. 3. In FIG. 2 and FIG. 3, step numbers are given the mark ST (as is the case with flowcharts described later).

The color original is placed on the color scanner 31 and the stencil-making device 30 is set to multi-color printing mode.

When the hue and printing density of ink used in multi-color printing is to be identified, the hue and printing density of the ink used and the corresponding extracted colors are all inputted via an operating panel (not shown) (ST21, 22). Upon this input, a system microcomputer (not shown) sets a color of the inputted ink that is of the greatest printing density at the color separation circuit 36 as a designated color for making a histogram (ST23). The color of the densest printing density of the colors in the ink used can also be set directly as the designated color for making a histogram at the color separation circuit 36.

When the hue and density of the ink to be used is not discerned, the inputting of step 22 is not carried out. In such a case, the color black is set at the color separation circuit 36 as the designated color for making a histogram (ST24).

When setting of the designated color for making a histogram at the color separation circuit 36 is complete, the histogram producing circuit 34 is initialized (ST25), the original is read-in (pre-scanned), and the histogram data HD is acquired. Stencil-making is not carried out during the pre-scan operation. In such a case, the histogram data HD is based on the image data D2 for the extracted original color because the color separation circuit 36 outputs the image data D2 for making a histogram to the color separation circuit 36. The acquired histogram data HD is then temporarily stored in memory 37 (ST26). It is sufficient to carry out this pre-scanning just once for the designated color for making a histogram for a group of stencils made for multi-color, multi-stencil printing.

When storage of the histogram data HD to the memory 37 is complete, the histogram data HD is read from the memory 37 and stencils for each color ink used in the printing are made while carrying out histogram control.

Namely, in step 22, if the hue of the ink used in printing is inputted, one color of the colors inputted is set at the color separation circuit 36 as the printing color, the printing color drum is changed, histogram data HD is read from the memory 37 while reading the original for this printing color (main scan) and histogram control is carried out, and the stencil for this printing color is made (ST27 to 32). The printing color set at the color separation circuit 36 is then changed and stencils are made sequentially until stencils for all of the inputted colors are made (ST33).

On the other hand, in step 22, if the hue etc. of the inks used in printing are not inputted, the printing colors are inputted (ST28) and the stencil-making is carried out as described above.

In steps 27 to 33, histogram control is carried out based on the histogram data HD for the same color stored in the memory 37 regardless of which color the stencil actually made is for and the hue of regions printed in an overlaid manner is therefore appropriate.

Figure 4:
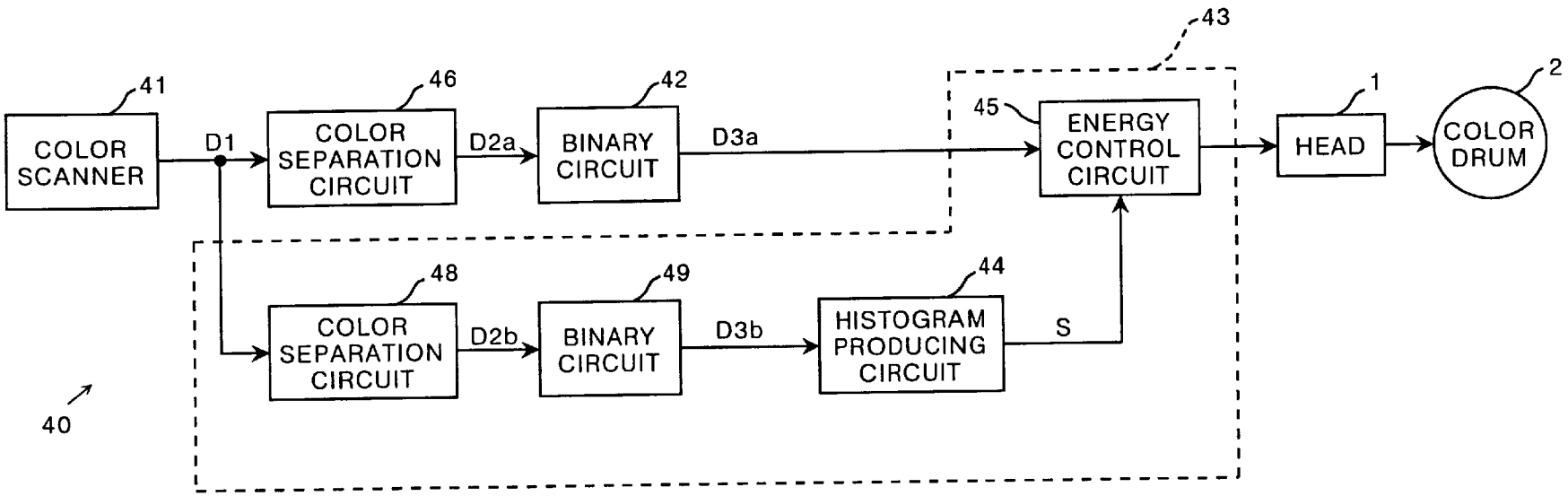
FIG. 4 is a block circuit diagram of a further embodiment of a stencil making device of the present invention.

FIG. 4 is a block circuit diagram of a stencil-making device equipped with an independent color separation circuit for making histogram data. As shown in FIG. 4, a stencil-making device 40 differs from the stencil-making device 30 in that, a histogram producing circuit 44 obtains the histogram data HD based on the outputs of the color separation circuit 48 and a binary circuit 49, which are separate from a color separation circuit 46 for making perforation data and a binary circuit 42.

Figure 5:
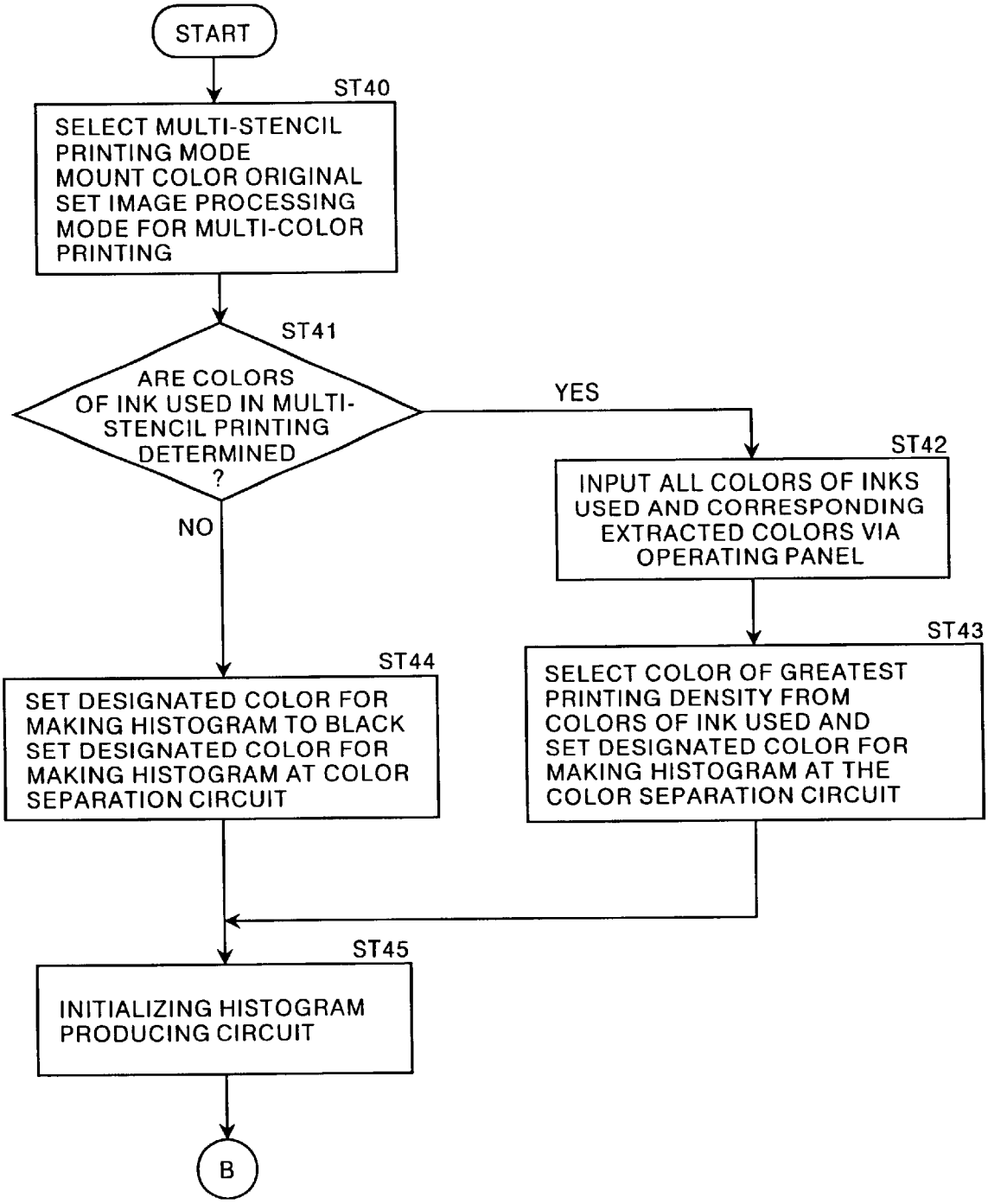
FIG. 5 is a first flowchart describing the operation of the stencil-making device of the further embodiment (one of two)
Figure 6:
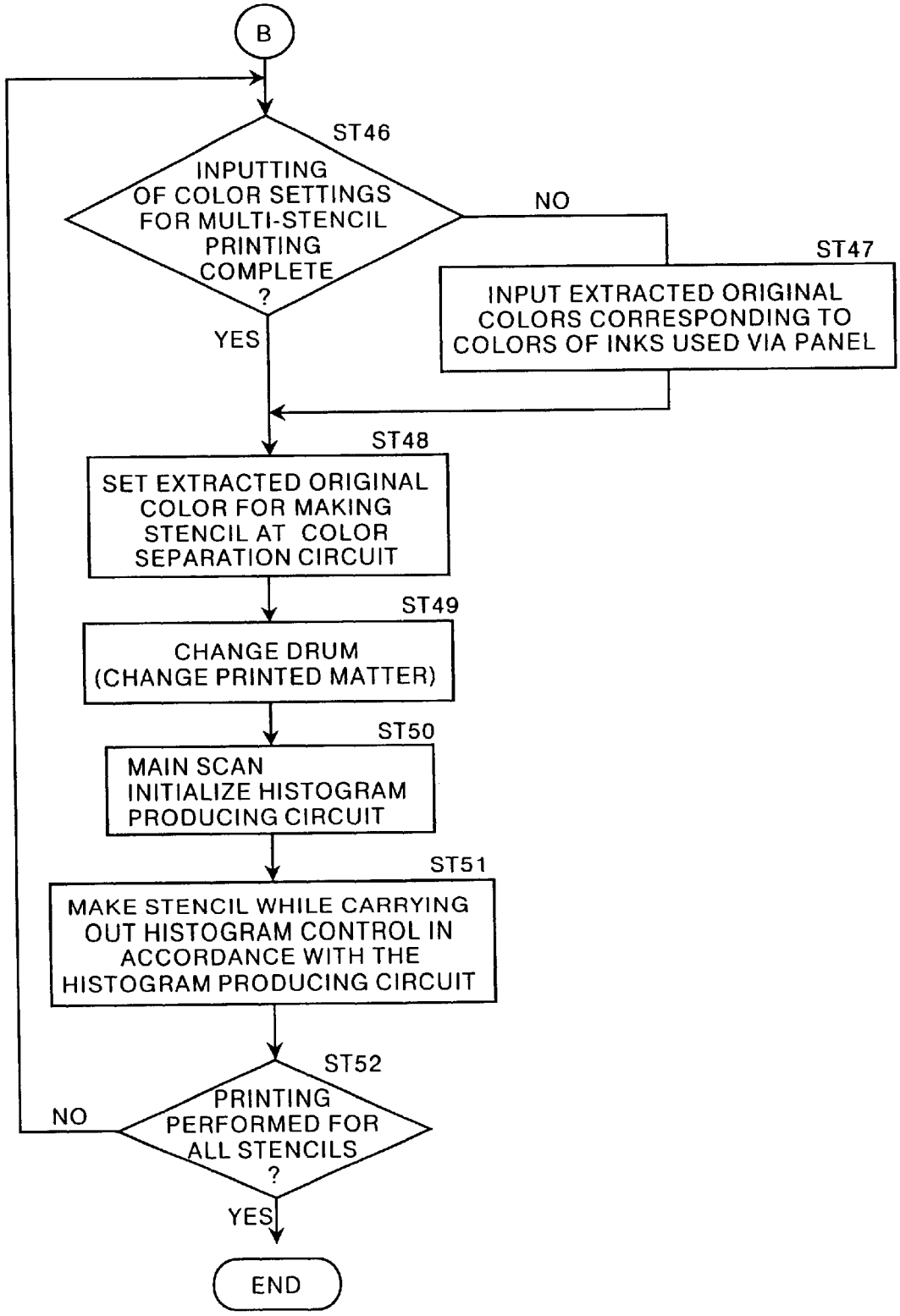
FIG. 6 is a second flowchart describing the operation of the stencil-making device of the further embodiment (two of two).

The following is a description of the operation of the stencil-making device 40 with reference to flowcharts shown in FIG. 5 and FIG. 6. Steps 40 to 45 in FIG. 5 are the same as steps 84) 20 to 25 shown in FIG. 2. The setting of designated colors for making histograms in step 43 and 44 is carried out at the color separation circuit 48.

When setting a designated color to be extracted for making a histogram to the color separation circuit 48 ends, the histogram producing circuit 44 is initialized (ST45), the histogram data HD is obtained, and stencils for each color ink used in printing are made while carrying out histogram control.

Namely, in step 42, if the hue of the ink used in printing is inputted, one color of the colors inputted is set at the color separation circuit 46 as the printing color, the printing color drum is changed, histogram control is carried out based on the applied energy control signal S outputted from the histogram producing circuit 44 while reading the original for this printing color (main scan), and the stencil for this printing color is made (ST46 to 51). The setting of the printing color to the color separation circuit 46 is then changed and stencils are made sequentially until stencils for all of the inputted colors are made (ST52). On the other hand, in step 42, if the hue etc. of the inks used in printing are not inputted, the printing colors are inputted (ST47) and the stencils are made.

In step 46 to step 52, the histogram producing circuit 44 obtains the histogram data HD for the designated color for making a histogram set at the color separation circuit 48 even when the color for printing set to the color separation circuit 46 is changed over. Histogram control can therefore be carried out based on the histogram data HD for the same color for the stencils for all of the colors regardless of the actual color to be printed using the stencil and the hue of regions where printing is overlaid is therefore also appropriate in this example.

In the above, a description is give of control of applied energy for all of the stencils for colors of ink used in printing based on histogram data for a color of the greatest printing density of colors of ink used in printing or for a color of a different hue to any of the colors of ink used in printing and of the greatest density (black in the above example). However, the present invention is by no means limited in this respect, and when a stencil for at least one color is made, applied energy control can be carried out based on heating data for a prescribed color having a greater density than the density of the ink used in the printing in which this stencil is used.

What is claimed is:

1. A stencil-making device, for making stencils used in multi-color printing using a thermal head, comprising:

energy control means for subjecting energy to be applied to the thermal head to histogram control based on heating data for a number of previous lines in a sub-scanning direction of the head;

wherein the energy control means obtains the heating data from a first color of a density greater than the density of ink of a second color used in a current printing and subjects a current stencil to applied energy control based on the obtained heating data.

2. A stencil-making device, for making stencils used in multi-color printing using a thermal head, comprising:

energy control means for subjecting energy to be applied to the thermal head to histogram control based on heating data for a number of previous lines in a sub-scanning direction of the head;

wherein the energy control means obtains the heating data from a color of a different color and hue to and greater density than any color of ink used in the printing and subjects stencils for all of the colors used in the printing to energy control based on the heating data.

3. A stencil-making device, for making stencils used in multi-color printing using a thermal head, comprising:

energy control means for subjecting energy to be applied to the thermal head to histogram control based on heating data for a number of previous lines in a sub-scanning direction of the head;

wherein the energy control means obtains the heating data from the densest color of the colors of inks used in the printing, and subjects the stencils for all of the colors used in the printing to energy control based on this heating data.

4. The stencil-making device of any one of claim 1 to 3, wherein the energy control means further comprises color separation means, provided separately from color separation means for color-separating inputted image data for use in making perforation data, for color-separating inputted image data for use in calculating heating data.

* * * * *